US005302017A

United States Patent [19]

Platek et al.

[11] Patent Number: 5,302,017

[45] Date of Patent: Apr. 12, 1994

[54] ROTATING MIXING DRUM WITH REPLACEABLE LINER FOR MIXING AGGREGATE AND BINDER

[75] Inventors: Raymond C. Platek, Port Washington; Robert W. Cramer, Brookfield, both of Wis.

[73] Assignee: Construction Forms, Inc., Cedarburg, Wis.

[21] Appl. No.: 926,680

[22] Filed: Aug. 7, 1992

[51] Int. Cl.[5] ..... B28C 5/18; B28C 7/16; B01F 15/02

[52] U.S. Cl. ..... 366/57; 366/47; 366/62; 366/185; 366/225

[58] Field of Search ..... 220/408, 409, 410, 468, 220/466; 366/53-59, 45-47, 62, 63, 185, 219, 225, 226

[56] References Cited

U.S. PATENT DOCUMENTS

| | | | |
|---|---|---|---|
| 1,500,322 | 7/1924 | Ionides | 366/57 |
| 1,933,455 | 10/1933 | Sommers | 366/185 |
| 2,573,296 | 10/1951 | Arant . | |
| 2,608,259 | 9/1952 | Pshoi | 366/225 |
| 3,058,642 | 10/1962 | Hester | 220/468 |
| 3,138,367 | 6/1964 | Raether | 366/225 |
| 4,521,116 | 6/1985 | Adsit . | |
| 4,634,284 | 1/1987 | Bishop | 366/57 |
| 4,756,444 | 7/1988 | Persoon . | |
| 4,808,092 | 2/1989 | Funke . | |
| 4,877,327 | 10/1989 | Whiteman, Jr. . | |
| 5,118,198 | 6/1992 | Whiteman | 366/57 |

FOREIGN PATENT DOCUMENTS

| | | | |
|---|---|---|---|
| 625789 | 12/1926 | France | 366/57 |
| 8802687 | 6/1990 | Netherlands | 366/54 |
| 2217620 | 11/1989 | United Kingdom | 366/54 |
| 2224219 | 5/1990 | United Kingdom | 366/60 |

*Primary Examiner*—Harvey C. Hornsby
*Assistant Examiner*—Terrence R. Till
*Attorney, Agent, or Firm*—Andrus, Sceales, Starke & Sawall

[57] ABSTRACT

A mixing drum unit for mixing a plastic resin and an aggregate includes a metal support drum and a plastic liner resting in the drum. An outer cover is secured to the drum overlying the outer end of the liner. The liner includes a cylindrical portion telescoped into the drum extending outwardly to an outer frustoconical portion having an outer end opening. The liner has a V-shaped shallow base which promotes mixing and ease of cleaning. The drum and liner include telescoping drive paddles which extend axially throughout the liner and project radially for coupling. The liner drive paddles extend into the outer frustoconical liner portion. The liner paddles have a radial wall and an inclined wall with an inner apex. The paddles are asymmetrically arranged about the drum and liner with at least one paddle spaced asymmetrically between the two adjacent paddles. The drum paddle is a metal plate projecting radially into the triangular liner paddle for direct coupling therebetween. The cover, where used, compliments and mates with the cylindrical projection of the drum projection and the frustoconical liner portion. The cover is releasably attached abutting the drum end by releasable latches.

6 Claims, 1 Drawing Sheet

ROTATING MIXING DRUM WITH REPLACEABLE LINER FOR MIXING AGGREGATE AND BINDER

BACKGROUND OF THE INVENTION

This invention relates to a aggregate/binder rotating mixing drum with a replaceable liner, and particularly to such a mixing drum for mixing an aggregate with a plastic binder.

Mixing drums are used for mixing of various materials to form a substantially uniform mixture of the several different materials or ingredients. Metal mixing drums are widely used in many applications because of the improved wear characteristics. Typically, in concrete and other similar binder and aggregate based mixing systems, various metal drums have been designed and are widely used for intermixing of the cement, aggregate and other materials to form a final product such as concrete and the like. With the development of plastic binders, various products have been developed involving the inter-mixing of aggregate material and a plastic binder material. A particular product which has been developed includes an epoxy resin binder which is intermixed with decorative aggregate to form a decorative material which is applied as a final decorative surface. The decorative material is generally applied as a decorative top layer overlying a concrete and other similar underlayments for patios, driveways and the like. The decorative material has been generally mixed in a conventional rotating mortar mixing drum having internal agitating and paddle units to insure thorough mixing, similar to the system used for many years for mixing cement and concrete. The mixing drum must be cleaned after each use to prevent build up and accumulation of product within the drum and thereby insure that subsequent mixtures are thoroughly intermixed and are not contaminated by the previous mixture. Cleaning can be particularly difficult when handling plastic binders such as epoxy resins.

Various mixing devices have been available with a liner removably secured to the drum for rotation with the drum, with a removable liner for easy cleaning after use of the mixing apparatus. U.S. Pat. No. 4,521,116 discloses a rotating drum apparatus in which a cylindrical drum is provided. A special plastic liner is bolted within the drum and includes a complementing cylindrical portion which telescopes into the drum and substantially conforms to the drum. The liner is bolted to the drum and rotates therewith. The liner includes an outer cone-shaped portion which is integrally formed with the cylindrical portion and which is specially constructed for positioning outwardly of the drum. The bolted liner can be released and removed for cleaning of epoxy mixture residue within the liner.

Although the liner promotes easy cleaning, the present inventor has found that epoxy resin aggregate mixing and the like presents certain problems with respect to the thoroughness of the mixing and the conventional construction of the liner and develops pockets within the system which interfere with the thorough mixing of the product and may result in undesirable agglomeration of residue within liner pockets which are difficult to clean thoroughly. Further, the projecting liner can raise certain questions with respect to the stability of the system, the required construction of the liner to withstand the forces encountered in loading and operating the lined mixer and the like.

SUMMARY OF THE PRESENT INVENTION

The present invention is directed to a lined mixing drum unit for intermixing of a plastic resin based binder and aggregate material, and in particular to a construction of a removable liner with an improved mixing capability, improved cleanability, simplicity of liner removal and having an overall higher strength and ruggedness than structures presently available or heretofore suggested.

The present invention is particularly directed to an improved liner and a releasable coupling in a rotating mixing drum unit for improved and cost effective intermixing of plastic resin binder and aggregate. Generally, in accordance with the present invention, the liner is formed with an elongated generally cylindrical portion in combination with an outer frustoconical or tapered portion terminating in the outermost end in a relatively small cylindrical opening for receiving of the materials for intermixing. The liner is releasably mounted within a support drum unit. The inner base of the liner is specially formed with a shallow concave, V-shaped configuration to promote thorough mixing of the aggregate and binder and ease of cleaning of the liner. The wall of the liner has socket type mixing paddles which project generally radially into the liner and axially throughout the liner for telescopic coupling to drive the member on the drum unit. The mixing paddles in a preferred construction extend into the tapered portion for strengthening the liner, promoting thorough mixing and movement of the product and ease of assembly into the drum and coupling to drive members of one drum unit. The mixing paddles are specially shaped with a radial face or wall for establishing a thorough and maximum mixing action. A trailing inclined wall is effective in reverse drum rotation for a thorough and more gentle mixing. The mixing paddles are also asymmetrically arranged for improved mixing. The liner is readily formed as a light weight element which may form a disposable element of the mixing apparatus.

The support drum unit includes a support drum which is specially formed of a high strength steel or other suitable material and includes a base portion and an outer peripheral cylindrical wall of a length somewhat less than the length of the cylindrical liner portion. The support drum has internal drive members, which generally are spaced and configured to mate with the liner mixing paddles. The drive members may be simple metal plate members formed as a flat plate member or shaped to correspond to the mixing paddles. The drive members project into the mixing sockets or paddles formed in the plastic drum liner to provide simple direct coupling of the drum and liner and thereby establish simultaneous rotation of the liner with the drum. The liner is not fixed to the drum but rather rests therein permitting direct lifting removal of the liner from the drum. The cylindrical portion of the liner includes a short cylindrical extension which projects outwardly from the support drum and terminates in the frustoconical or tapered portion. In one embodiment, the support drum unit includes a rigid outer shell or cover which is shaped to complement the cylindrical extension and the frustoconical portion of the drum liner. The cover is firmly affixed to the outer end of the support drum by a releasable latch assembly to form a total enclosure and a rigid and strong support of the liner. The mixing apparatus may operate without the cover, but the support unit preferably includes a cover and a releasable latch and clamping mechanism to further support the liner in place.

The present invention, with the unique liner and coupling, provides a high strength system with improved mixing of the materials as well as cleaning of the liner such that cross contaminants of colored material and the like can be avoided. Further, the liner can be used as a disposable element of a rental mixing apparatus.

BRIEF DESCRIPTION OF THE DRAWINGS

The drawings herewith generally illustrate the best mode presently contemplated for carrying out the invention and are described hereinafter.

In the drawings.

DESCRIPTION OF THE ILLUSTRATED EMBODIMENT

Figure 1:
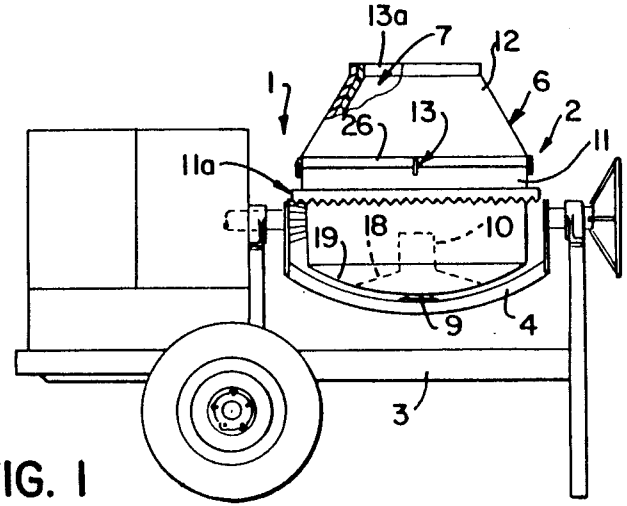
FIG. 1 is an elevational view of a mixing apparatus incorporating a preferred embodiment of the invention.

Referring to the drawings and particularly to FIG. 1, an aggregate mixing apparatus 1 is illustrated including a rotating drum assembly or unit 2 rotatably mounted on a suitable support 3, which may be in accordance with various known constructions or other suitable constructions. The rotating drum unit 2 is rotatably mounted to a yoke 4 which in turn is pivotably mounted to the wheeled support 3. The yoke allows orientation of drum unit 2 in an upwardly angled orientation for mixing of an aggregate and binder mixture 5, and downwardly for discharging the thoroughly mixed material mixture 5. The present invention is particularly directed to the construction of the rotating drum unit 2 for mixing of an aggregate with a plastic binder such as an epoxy resin. Such an aggregate mixture 5, as previously discussed, presents certain difficulties from the standpoint of preventing buildup of resin within the rotating unit 2 which will interfere with the subsequent use of the unit. The support structure, as well as the pivot and rotating drive structure, are known and various constructions and units or drive systems can be provided with the desired rotation and pivotal motions. Such structure is therefore not disclosed or described in detail other than in reference to describing the drum unit 2 which provides a preferred embodiment of the invention.

The rotating drum unit 2 generally includes an outer drum 6 of steel or other suitable material, within which a mating plastic liner 7 is releasably disposed. The drum 6 is a generally cup-shaped member having a base wall 8 which is rotatably mounted on a bearing unit 9 within the yoke 4. The bearing unit 9 projects into the base wall 8, which has an integral receiving hub 10. The drum 6 has an integral cylindrical side wall 11 which opens at the outer end. A motorized drive assembly 11*a* is coupled to rotate the drum 6 in accordance with a suitable drive system such as those presently in use. A conically shaped cap or cover 12 is releasably secured to the outer open end of the drum 6 as by a plurality of releasable latch units 13. The outer end of the drum cover 12 includes a reduced opening 13*a* through which the aggregate mixture 5 is introduced into and discharged from the drum unit 2. The plastic liner 7 has a configuration substantially identical to and conforming to the drum 6 and the cover 12 and rests within the drum 6. The plastic liner 7 is a relatively thin but rigid plastic such as a linear low density polyethylene. The liner 7 rests within the drum 6 and cover 12 and is further positively supported in place as a result of the cover 12 to support the liner during the rotation and mixing as well as during the discharge of the aggregate mixture. The drum 6 and the liner 7 have telescoping interlocking drive members 14 and 15, which form a plurality of couplings respectively, such that rotation of the drum 6 directly drives the liner 7 therewith, without the necessity of any other interconnecting fixed members such as bolts or the like. The drive members 14 and 15 are generally distributed throughout the drum circumference. In the illustrated embodiment, four drive couplings are shown with one coupling 16 asymmetrically located with respect to the other three couplings 17 which are circumferentially spaced by ninety degrees.

The illustrated drum unit 2 in use is assembled with the liner 7 and cover 12 in place. The aggregate and binder are introduced into the drum unit 2 which is then rotated to thoroughly intermix the material to form mixture 5. Pivoting of the drum unit 2 to a discharge position provides for direct discharge of the mixture. To clean the drum unit, the cover 12 is removed and the liner 7 directly lifted from the drum 6. A suitable cleaning fluid is introduced into the drum to thoroughly wash and remove any remaining residue from within the liner including aggregate and all plastic binder.

The combination of the liner 7 and the enclosing drum assembly 6 and 12 provides a reliable mixer which can be constructed with present day technology and establishes a long operating life. In addition, the liner, which rests in the rotating drum 6 with the releasably telescoping drive members 14 and 15, is readily disassembled from the drum 6 for cleaning and the like by simply removing of the releasable cover 7 and lifting the liner 6 directly from the drum unit.

Figure 4:
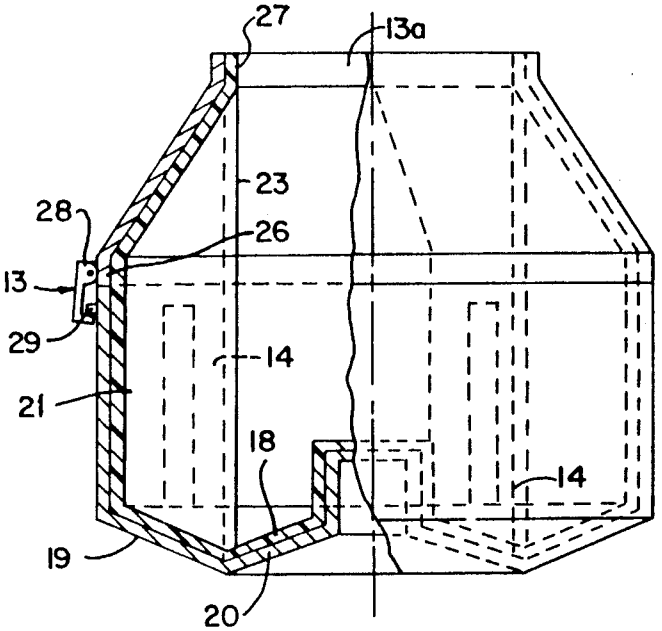
FIG. 4 is an end view of the drum and liner shown in FIGS. 1–3, with parts broken away and sectioned.
Figure 2:
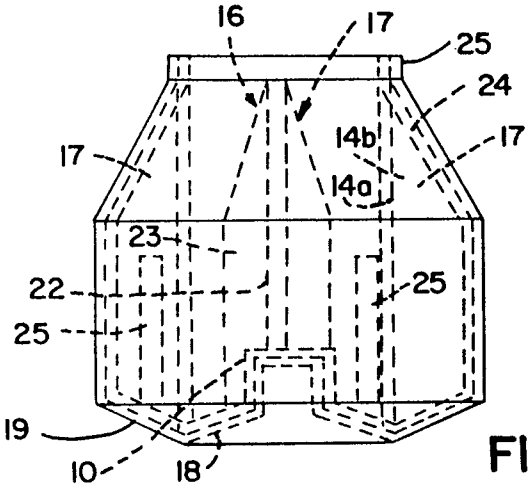
FIG. 2 is an elevational view of a liner of the mixing apparatus shown in FIG. 1.
Figure 3:
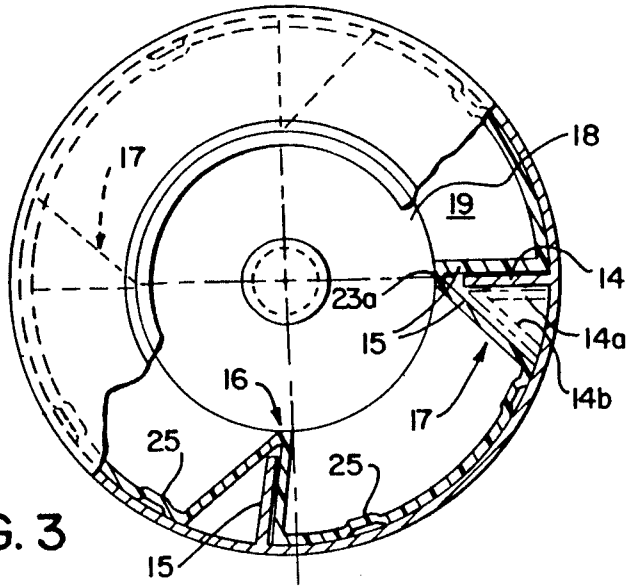
FIG. 3 is an enlarged top elevational view of the drum and liner shown in FIGS. 1 and 2, with parts broken away and sectioned to illustrate detail of construction.

More particularly, in the illustrated embodiment of the invention, the generally cup-shaped drum 6 is formed with the continuous base wall 8 and the cylindrical sidewall 11. The base wall 8 is formed with the central inwardly projecting bearing hub 10 which telescopes downwardly over the support bearing, not shown. Between the hub 10 and the outer sidewall 11, the base wall 8 of the drum is especially shaped with a generally shallow V-shaped cross-section, as shown most clearly in FIG. 4, with an inclined inner wall portion 18 projecting radially outwardly and axially outwardly. A reverse inclined outer wall portion 19 is integrally connected to the outer edge of the inner wall portion 18 and extends outwardly into integral interconnection with the cylindrical sidewall 11. Walls 18 and 19 are shown of essentially similar lengths and angular inclination. The liner 7 has a corresponding base wall structure 20. The V-shaped base wall structure promotes the movement of mixture from the drum walls and promotes a more thorough and uniform mixing of the final product. A combination of the hub and the shallow V-shaped wall in the drum 6, and the corresponding structure in the liner 7 further minimizes any sharp right angled corners within the structure of the liner 7 and promotes convenient and rapid cleaning of inner and bottom portion of liner 7.

The drive members 14 and 15 on the drum 6 and liner 7 are shown as follows. The cylindrical sidewall 11 of the drum 6 includes a plurality of circumferentially distributed drive plates for members 14, shown as four identical plates. Each plate 14 is similarly constructed of a suitable rigid metal or other suitable material and may be a single flat plate, as illustrated. Suitable reinforcements and supports may be provided. Alternatively, each plate 14 may be formed, having a V-shaped cross-section, as shown in phantom, and include a radial wall 14*a* and an inclined wall 14*b* corresponding generally to the mixing paddles.

Each drive plate 14 is welded or otherwise intimately secured to the inner, wall of the drum 6. The plate 14 also extends substantially throughout the depth of the drum sidewall. The plates 4 of couplings 17 are equally spaced throughout 270° of the drum and then at 90° from each other. The plate 14 for the offset coupling 16 is asymmetrically located with respect to couplings 17, and in particular is circumferentially offset between the two adjacent couplings 17 by a relatively small angle, shown as substantially 5°.

The liner 7 is formed to mate the drum and cover assembly and generally includes a cylindrical wall 21 which fits closely within the drum 6 and extends outwardly therefrom. The liner 7 has the inwardly extended drive 15 shown as open-ended recess paddles extending from the base wall throughout the axial length of the liner. The coupling recesses 15 form internal paddles permitting telescoping of the liner 7 directly into the drum for direct coupling to the drive plates 14. The liner 7 thus rests within the drum 6 with the only drive coupling between the liner and drum provided by the telescoped plates 14 and paddle recesses 15.

The drive recesses or paddles 15 are in one feature of the illustrated embodiment, extended through-out the axial length of the liner 7 including the frustoconical portion. Each paddle is formed of a V-shaped configuration including a substantially radial wall 22 and a trailing flat inclined wall 23 joined at an inner apex 23*a*. The outer side of each recess is open for mating engagement with a drive plate 14. The generally radial wall 22 is located as the leading wall for normal forward rotation of the drum unit. The flat inclined wall 23 is operative during a reverse rotation of the drum unit 2 and provides a more gentle mixing action. Each recessed paddle has a radial extent to locate the inner edge or apex 23*a* in substantial alignment with the opening 13*a* to the drum unit 2.

The asymmetrical location of at least one coupling unit 16 promotes mixing of the aggregate and the plastic resin to provide an improved thorough mixing thereof.

In the illustrated embodiment of the invention, the cylindrical wall 21 of the liner 7 projects outwardly as a continuous cylindrical portion for a short distance beyond the outer end of drum 6. In a practical application, the liner wall 21 may project outwardly on the order of 10 inches. A generally frustoconical wall 24 extends from wall 21 and tapers axially outwardly and radially inwardly to the reduced opening 13*a*. The outer end of the liner includes a short axial cylindrical projection located within opening 13*a* and abutting the similar wall of covers.

The liner 7 is also formed with a plurality of integral axially extended ribs 25 within the cylindrical wall 21. Each rib 25 is shown as a slight inward projection of the liner wall 21 and the ribs are non-uniformly distributed. The ribs have a length generally equal to t he depth of the drum 6 and serve to strengthen the thin wall liner 7. Where the drum construction has an outer bolted element such as ring drive, the ribs are located for alignment with each bolt location to again permit the free telescoping of the liner relative to the drum.

The drum cover 12 corresponds in configuration to the outer wall of the liner 7 and in the assembled relation fits closely over the liner. The cover 12 is formed of a steel or other suitable material, similar to that of the drum 6 in the illustrated embodiment of the invention. The cover 12 particularly includes a cylindrical wall 26 of a diameter corresponding to that of the drum 6 and of a length corresponds to the outward extension of the liner wall 21 from drum 6. The cylindrical wall 26 abuts the adjacent opening edge of the drum 6 and is secured in place by the plurality of releasable latch units 13, which are circumferentially spaced about the drum.

Each latch unit 13 includes a pivoted lever 28 connected to the drum unit and a mating complementing lug 29 secured to the cover 12. Although any suitable coupling can be employed, the type of latch unit 13 illustrated provides a positive and readily release connection.

The frustoconical or tapered wall of cover 12 extends from wall 26 and mates with the wall 24 of liner 7, including a round section 27 mating with the outer tubular opening wall section of liner 7 within opening 13*a* to establish a protective support and enclosure of the liner.

The illustrated embodiments discloses the preferred embodiment including the unique combination of the support and liner and a unique liner structure. Various other embodiments may be made. Thus, the liner with the direct drive coupling may be used without the cover within the teaching of this invention. The direct releasable drive couplings may be constructed with other shaped mating elements which permit the telescopic releasble coupling. These and other structures are within the scope of the accompanying claims.

Various modes of carrying out the invention are contemplated as being within the scope of the following claims particularly pointing out and distinctly claiming the subject matter which is regarded as the invention.

I claim:

1. A mixing drum liner adapted to be disposed within a rotating mixing drum formed of a strong rigid self-supporting material and having a cylindrical outer wall and internal radial drive members projecting inwardly from said outer wall, said drive members extending axially for substantially the length of said mixing drum and being circumferentially spaced, said drum liner comprising a single integral member having side walls having a cylindrical drum portion and an outer cone-shaped extension having a side wall projecting co-axially outwardly of said side wall of said cylindrical drum portion and terminating in an outer open end, a base wall closing the inner end of said drum portion, and said cylindrical drum portion having a length extending outwardly of said base wall a distance greater than the length of said rotating mixing drum whereby said cylindrical portion projects outwardly of said rotating mixing drum, said cylindrical portion having a plurality of paddle members connected to and projecting inwardly from the side walls of said cylindrical drum portion and outer cone-shaped extension throughout the total length of the liner, said paddle members being circumferentially spaced about the axis of said drum portion in accordance with the circumferential spaced of said drive members, said paddle members being substantially straight for alignment with said drive members, each of said paddle portions having circumferentially spaced walls joined at a radially inner end and defining an open end adjacent the base of the liner establishing direct placement and removal of the liner within said drum with said paddles mating with said drive members, and wherein each of said paddles projects substantially radially inwardly with said radially inner ends aligned with the opening to the liner.

2. The drum liner of claim 1, wherein each of said mixing paddles includes first and second side walls extending from an apex to the cylindrical drum portion, said first and second side walls having different angles of orientation, with a leading sidewall functioning to carry material upwardly of the rotating drum liner and said trailing wall serving to distribute said material over the drum and serving to intermix the material of said ingredients.

3. The mixing drum liner of claim 1, wherein said base Wall includes a central hub port projecting inwardly of the base wall and a connecting sidewall interconnecting the hub to the outer cylindrical wall of said drum liner, said connecting wall having a substantially shallow convex V-shape configuration projecting axially outwardly of the cylindrical portion.

4. The mixing drum liner of claim 1, having a plurality of strengthening ribs integrally formed in said drum portion.

5. A mixing drum assembly for mixing of aggregate and plastic resin binder materials for placement of a decorative cover over a concrete surface, comprising a rigid undersupport structure, a mixing drum member having a generally cup-shaped configuration with a supporting base wall, a cylindrical wall and an open end opposite said base wall, drive plates secured to said cylindrical wall and projecting radially inwardly, driven unit on said support structure, said mixing drum member being secured to said driven unit with said drum member at an angle to the horizontal and locating said open end in inwardly spaced relation to said base wall, and outer drum cover including a cylindrical portion having a diameter essentially equal to the diameter of the open end of said drum member, cooperating connecting elements on said drum member and said cylindrical portion of said drum cover for releasably and firmly connecting said drum cover as an extension of said mixing drum member, said cover including a generally cone-shaped outer portion projecting outwardly from said cylindrical portion and terminating in an outer opening for introduction of material into said mixing drum member, a plastic liner including a cylindrical drum portion essentially corresponding in shape to the drum and located within said drum, said cylindrical drum portion having an outer cylindrical extension and an outer cone-shaped portion, said outer cylindrical extension and said outer cone-shaped portion essentially corresponding to said cylindrical portion and said cone-shaped portion of said cover and being located within said cover, said liner having inwardly projecting mixing paddles located within and coupled to said drive plates on said mixing drum member, said mixing paddles and plates defining the sole driving connection of said drum to said liner, said drive plate members extending axially for substantially the length of said mixing drum, and said mixing drum paddles being substantially straight for alignment with said drive plates and extending through the total length of the liner, said mixing paddles being open at the end adjacent said base wall and permitting the free insertion and removal of said liner with said cover released from said mixing drum.

6. A mixing drum assembly for mixing of aggregate and plastic resin binder materials for placement of a decorative cover over a concrete surface, comprising a support structure, a mixing drum member having a generally cup-shaped configuration with a supporting base wall connected to a cylindrical wall and an open end opposite said base wall, a driven unit on said support structure, said mixing drum member mounted on said support and coupled to said driven unit with said drum member at an angle to the horizontal and locating said open end in upwardly spaced relation to said base wall, said mixing drum liner adapted to be disposed within said rotating mixing drum, said mixing drum formed of a strong rigid self-supporting material and having internal radial drive members projecting inwardly from said cylindrical wall, said drive members extending axially for substantially the length of said mixing drum and being circumferentially spaced, said drum liner comprising a single integral member having side walls having a cylindrical drum portion and an outer cone-shaped extension having a side wall projecting co-axially outwardly of said side wall of said cylindrical drum portion and terminating in an outer open end, a base wall closing the inner end of said drum portion, and said cylindrical drum portion having a length extending outwardly of said base wall a distance greater than the length of said rotating mixing drum whereby said cylindrical portion projects outwardly of said rotating mixing drum, said cylindrical portion having a plurality of paddle members connected to and projecting inwardly from the side wall of said cylindrical drum portion and outer cone-shaped extension throughout the total length of the liner, said paddle members being circumferentially spaced about the axis of said drum portion in accordance with the cicumferential spaced of said drive members, said paddle members being substantially straight for alignment with said drive members, each of said paddle portions having circumferentially spaced walls joined at a radially inner end and defining an open end adjacent the base of the liner establishing direct placement and removal of the liner within said drum with said paddles mating with said drive members, and wherein each of said paddles projects substantially radially inwardly with said radially inner ends aligned with the opening to the liner.

* * * * *

UNITED STATES PATENT AND TRADEMARK OFFICE

CERTIFICATE OF CORRECTION

PATENT NO. : 5,302,017
DATED : April 12, 1994
INVENTOR(S) : Raymond C. Platek et al It is certified that error appears in the above-indentified patent and that said Letters Patent is hereby corrected as shown below:

Claim 1, Col. 7, line 5, delete "portions" and substitute therefor ---members---; Claim 1, Col. 7, line 7, after "base" insert ---wall---; Claim 3, Col. 7, line 23, delete "Wall" and substitute therefor ---wall---; Claim 3, Col. 7, line 23, delete "port" and substitute therefor ---portion---.

Signed and Sealed this

Twentieth Day of September, 1994

*Attest:*

Bruce Lehman

BRUCE LEHMAN

*Attesting Officer*

*Commissioner of Patents and Trademarks*